US011125236B2

(12) United States Patent
Yamashita

(10) Patent No.: US 11,125,236 B2
(45) Date of Patent: Sep. 21, 2021

(54) CENTRIFUGAL COMPRESSOR

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 79 days.

(21) Appl. No.: 16/482,513

(22) PCT Filed: Feb. 22, 2018

(86) PCT No.: PCT/JP2018/006423
§ 371 (c)(1),
(2) Date: Jul. 31, 2019

(87) PCT Pub. No.: WO2018/155546
PCT Pub. Date: Aug. 30, 2018

(65) Prior Publication Data

US 2020/0049155 A1 Feb. 13, 2020

(30) Foreign Application Priority Data

Feb. 23, 2017 (JP) ..... JP2017-032022

(51) Int. Cl.
*F04D 17/10* (2006.01)
*F04D 17/12* (2006.01)

(52) U.S. Cl.
CPC ..... *F04D 17/10* (2013.01); *F04D 17/12* (2013.01); *F04D 17/122* (2013.01)

(58) Field of Classification Search
CPC ..... F04D 17/10; F04D 17/12; F04D 17/122
See application file for complete search history.

(56) References Cited

U.S. PATENT DOCUMENTS 8,632,302 B2 * 1/2014 Sorokes ..... F04D 29/444 415/161
2013/0259644 A1 * 10/2013 Kobayashi ..... F04D 17/122 415/68

FOREIGN PATENT DOCUMENTS

JP JH09203394 A * 8/1997 ..... F04D 17/122
JP 2012-087646 A 5/2012

OTHER PUBLICATIONS

English Translation of JH09203394A (Minoru) obtained Dec. 15, 2020 (Year: 2020).*

(Continued)

*Primary Examiner* — Connor J Tremarche
(74) *Attorney, Agent, or Firm* — Osha Bergman Watanabe & Burton LLP

(57) ABSTRACT

A casing surrounds a rotary shaft and impellers (4), and includes a return flow path through which a fluid discharged from the impeller (4) on a front stage side between the impellers (4) adjacent to each other is guided inward in a radial direction so as to be introduced to the impeller (4) on a rear stage side, and a plurality of return vanes (50) disposed at an interval in a circumferential direction inside the return flow path. An exit angle of the return vane (50) is inclined forward in a rotation direction of the impeller (4), according to the radial direction, and the exit angle of the return vane (50) decreases toward the return vane (50) on the rear stage side.

2 Claims, 4 Drawing Sheets

(56) References Cited

OTHER PUBLICATIONS

International Search Report and Written Opinion in corresponding International Application No. PCT/JP2018/006423, dated May 29, 2018 (9 pages).

* cited by examiner

CENTRIFUGAL COMPRESSOR

TECHNICAL FIELD

The present invention relates to a centrifugal compressor.

Priority is claimed on Japanese Patent Application No. 2017-032022, filed on Feb. 23, 2017, the content of which is incorporated herein by reference.

BACKGROUND ART

As a centrifugal compressor used for an industrial compressor, a turbo refrigerator, a small gas turbine, and a pump, a multistage centrifugal compressor is known which includes an impeller in which a plurality of blades are attached to a disk fixed to a rotary shaft. The multistage centrifugal compressor provides gas with pressure energy and velocity energy by rotating the impeller.

For example, Patent Document 1 discloses the multistage centrifugal compressor in which an exit angle of a return vane gradually increases toward a rear stage side.

CITATION LIST

Patent Literature

[Patent Document 1] Japanese Unexamined Patent Application, First Publication No. 2012-87646

SUMMARY OF INVENTION

Technical Problem

Incidentally, the multistage centrifugal compressor disclosed in Patent Document 1 above cannot sufficiently secure a surge margin and a choke margin, thereby causing a possibility that an operation range may decrease.

The present invention provides a multistage centrifugal compressor which can broaden an operation range.

Solution to Problem

According to a first aspect of the present invention, there is provided a centrifugal compressor including a rotary shaft rotated around an axis, impellers disposed so as to form a plurality of stages in a direction of the axis with respect to the rotary shaft and is configured to be pumped a fluid flowing from an inlet on one side in the direction of the axis to outward in a radial direction, a casing that surrounds the rotary shaft and the impellers, and that has a return flow path through which the fluid discharged from an impeller on a front stage side between the impellers adjacent to each other is guided inward in the radial direction so as to be introduced to an impeller on a rear stage side, and a plurality of return vanes disposed at an interval in a circumferential direction inside the return flow path. The exit angle of the return vane is inclined forward in a rotation direction of the impeller, according to the radial direction, and the exit angle of the return vane decreases toward the return vane on the rear stage side.

Here, as the exit angle of the return vane increases, the fluid provided with a larger prewhirl is introduced to the impeller subsequent to the return vane. As the prewhirl of the fluid increases, a head of the impeller decreases, and performance characteristics are changed to a small flow rate side. Conversely, if the prewhirl of the fluid decreases, the head of the impeller relatively increases. As a result, the performance characteristics are changed to a high flow rate side.

Generally, in the centrifugal compressor, the impeller on the rear stage side has a lower flow rate than the impeller on the front stage side. According to the present invention, the exit angle decreases toward the return vane on the rear stage side. Accordingly, the prewhirl generated by the return vane decreases toward the rear stage side. Therefore, the fluid having a small volume flow rate in accordance with a design flow rate of the impeller can be supplied to the impeller on the rear stage side.

In a case where the exit angle of the return vane increases toward the rear stage side, the fluid having a large volume flow rate is supplied to the impeller having a low flow rate on the rear stage side. Consequently, the choke margin excessively decreases. According to the present invention, this adverse effect can be avoided, and the choke margin can be secured.

In addition, in the multistage centrifugal compressor, the surge margin of the impeller on the front stage side is basically smaller than the surge margin of the impeller on the rear stage side. Therefore, according to the multistage centrifugal compressor, the entire surge margin is determined by the impeller on the front stage side.

According to the present invention, the prewhirl of the fluid introduced to the impeller increases toward the return vane on the front stage side. Therefore, the fluid having the large volume flow rate can be supplied more to the impeller on the front stage side. In a case where the exit angle of the return vane increases toward the rear stage side, the fluid having the small volume flow rate is supplied to the impeller having the small surge margin on the front stage side. Therefore, the surge margin decreases. According to the present invention, this adverse effect can be avoided, and the surge margin can be broadened.

In the above-described centrifugal compressor, a flow path cross-sectional area of the inlet of the impellers may decrease toward the impeller on the rear stage side.

According to the multistage centrifugal compressor configured in this way, the impeller having the large flow is switched to the impeller having the low flow rate from the front stage side toward the rear stage side. Therefore, both the choke margin and the surge margin can be broadened by increasing the exit angle of the return vane so that the prewhirl increases toward the rear stage side.

Advantageous Effects of Invention

According to the centrifugal compressor of the present invention, an operation range can be broadened.

DESCRIPTION OF EMBODIMENTS

Figure 1:
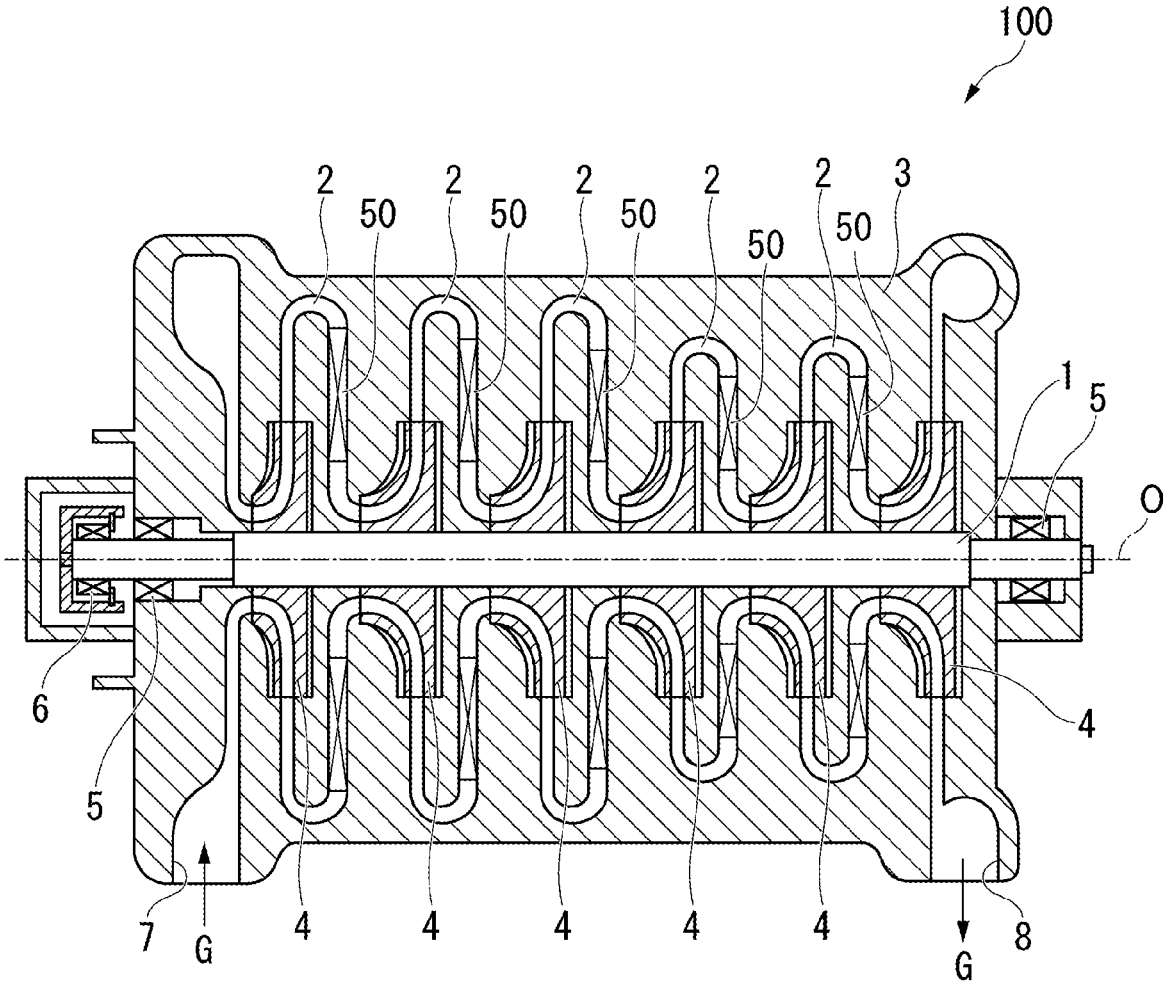
FIG. 1 is a longitudinal sectional view of a centrifugal compressor according to an embodiment.

Hereinafter, a centrifugal compressor according to a first embodiment of the present invention will be described with reference to the drawings. As shown in FIG. 1, a centrifugal compressor 100 includes a rotary shaft 1 rotated around an axis, a casing 3 forms a flow path 2 by covering the periphery of the rotary shaft 1, a plurality of impellers 4 disposed in the rotary shaft 1, and a return vane 50 disposed inside the casing 3.

The casing 3 has a cylindrical shape extending along an axis O. The rotary shaft 1 extends so as to penetrate through an interior of the casing 3 along the axis O. A journal bearing 5 and a thrust bearing 6 are respectively disposed in both end portions of the casing 3 in a direction of the axis O. The rotary shaft 1 is supported by the journal bearing 5 and the thrust bearing 6 so as to be rotatable around the axis O.

An intake port 7 for fetching air serving as a working fluid G from the outside is disposed on one side of the casing 3 in the direction of the axis O. Furthermore, an exhaust port 8 for discharging the working fluid G compressed inside the casing 3 is disposed on the other side of the casing 3 in the direction of the axis O.

An internal space which allows the intake port 7 and the exhaust port 8 to communicate with each other and whose diameter is repeatedly reduced and enlarged is formed inside the casing 3. The internal space accommodates a plurality of impellers 4, and forms a portion of the above-described flow path 2. In the following description, a side where the intake port 7 is located on the flow path 2 will be referred to as an upstream side, and a side where the exhaust port 8 is located on the flow path 2 will be referred to as a downstream side.

Figure 2:
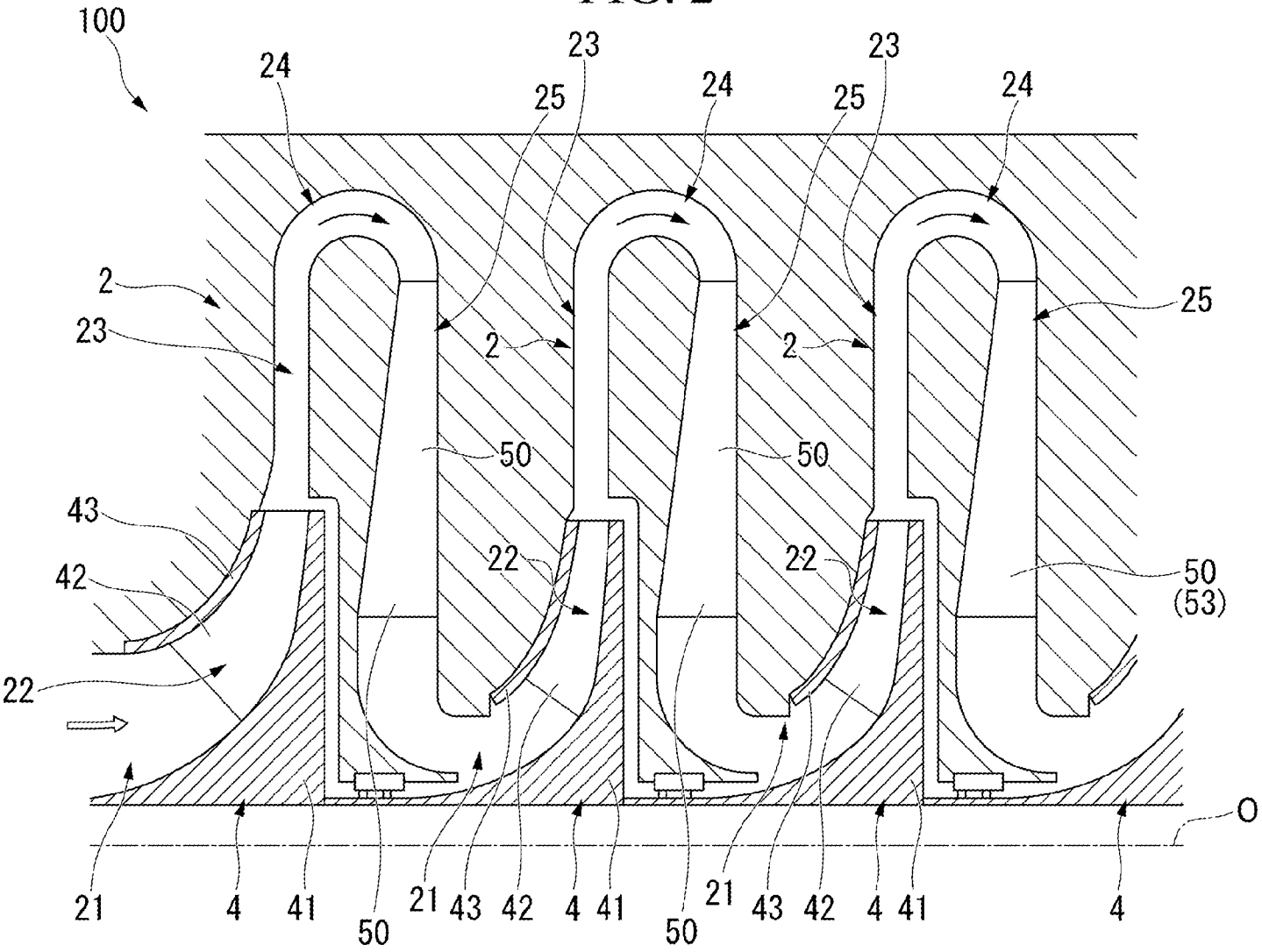
FIG. 2 is a longitudinal sectional view showing a partially enlarged portion of the centrifugal compressor according to the embodiment.

An outer peripheral surface of the rotary shaft 1 has the plurality of (six) impellers 4 at an interval in the direction of the axis O. As shown in FIG. 2, the respective impellers 4 have a disk 41 having a substantially circular cross section when viewed in the direction of the axis O, a plurality of blades 42 disposed on a surface on the upstream side of the disk 41, and a cover 43 which covers the plurality of blades 42 from the upstream side.

The disk 41 is formed so that a dimension in a radial direction is gradually broadened from one side to the other side in the direction of the axis O when viewed in a direction intersecting the axis O, thereby forming a substantially conical shape.

The plurality of blades 42 are radially arrayed outward in the radial direction around the axis O on a conical surface facing the upstream side out of both surfaces of the above-described disk 41 in the direction of the axis O. More specifically, the blades are formed of thin plates erected toward the upstream side from the surface on the upstream side of the disk 41. The plurality of blades 42 are curved from one side to the other side in a circumferential direction when viewed in the direction of the axis O.

The cover 43 is disposed in an end edge on the upstream side of the blades 42. In other words, the plurality of blades 42 are interposed between the cover 43 and the disk 41 in the direction of the axis O. In this manner, a space is formed among the cover 43, the disk 41, and the pair of blades 42 adjacent to each other. The space forms a portion of the flow path 2 (compression flow path 22, to be described later).

The flow path 2 is a space which allows the impeller 4 configured as described above and the internal space of the casing 3 to communicate with each other. In the present embodiment, an example will be described where one flow path 2 is formed for each impeller 4 (for each compression stage). That is, in the centrifugal compressor 100, five flow paths 2 continuous from the upstream side to the downstream side are formed corresponding to five impellers 4 except for the impeller 4 in a rearmost stage.

The respective flow paths 2 have a suction flow path 21, a compression flow path 22, a diffuser flow path 23, and a return flow path 30. FIG. 2 mainly shows the impellers 4 in first to third stages out of the flow paths 2 and the impellers 4.

In the impeller 4 in the first stage, the suction flow path 21 is directly connected to the above-described intake port 7. The suction flow path 21 fetches external air serving as the working fluid G into each flow path on the flow path 2. More specifically, the suction flow path 21 is gradually curved outward in the radial direction from the direction of the axis O as the suction flow path 21 faces from the upstream side to the downstream side.

The suction flow path 21 in the impellers 4 in the second and subsequent stages communicates with a downstream end of a guide flow path 25 (to be described later) in the flow path 2 in a front stage (first stage). That is, a flowing direction of the working fluid G passing through the guide flow path 25 is changed so as to face the downstream side along the axis O in the same manner as described above.

The compression flow path 22 is surrounded by a surface on the upstream side of the disk 41, a surface on the downstream side of the cover 43, and the pair of blades 42 adjacent to each other in the circumferential direction. More specifically, a cross-sectional area of the compression flow path 22 gradually decreases as the compression flow path 22 faces outward from the inside in the radial direction. In this manner, the working fluid G circulating in the compression flow path 22 in a rotated state of the impeller 4 is gradually compressed to be a high pressure fluid.

The diffuser flow path 23 extends outward from the inside in the radial direction of the axis O. An inner end portion in the radial direction in the diffuser flow path 23 communicates with an outer end portion in the radial direction of the above-described compression flow path 22.

The return flow path causes the working fluid G facing outward in the radial direction to turn inward in the radial direction and to flow into the impeller 4 in the subsequent stage. The return flow path is formed from a return bending portion 24 and the guide flow path 25.

In the return bending portion 24, the flowing direction of the working fluid G circulating outward from the inside in the radial direction through the diffuser flow path 23 is reversed inward in the radial direction. One end side (upstream side) of the return bending portion 24 communicates with the above-described diffuser flow path 23. The other end side (downstream side) of the return bending portion 24 communicates with the guide flow path 25. In an intermediate portion of the return bending portion 24, an outermost portion in the radial direction serves as a top portion. In the vicinity of the top portion, an inner wall surface of the return bending portion 24 has a three-dimensional curved surface so as not to hinder the flow of the working fluid G.

The guide flow path 25 extends inward in the radial direction from an end portion on the downstream side of the return bending portion 24. An outer end portion in the radial direction of the guide flow path 25 communicates with the above-described return bending portion 24. An inner end portion in the radial direction of the guide flow path 25 communicates with the suction flow path 21 in the flow path 2 in the rear stage as described above.

Figure 3:
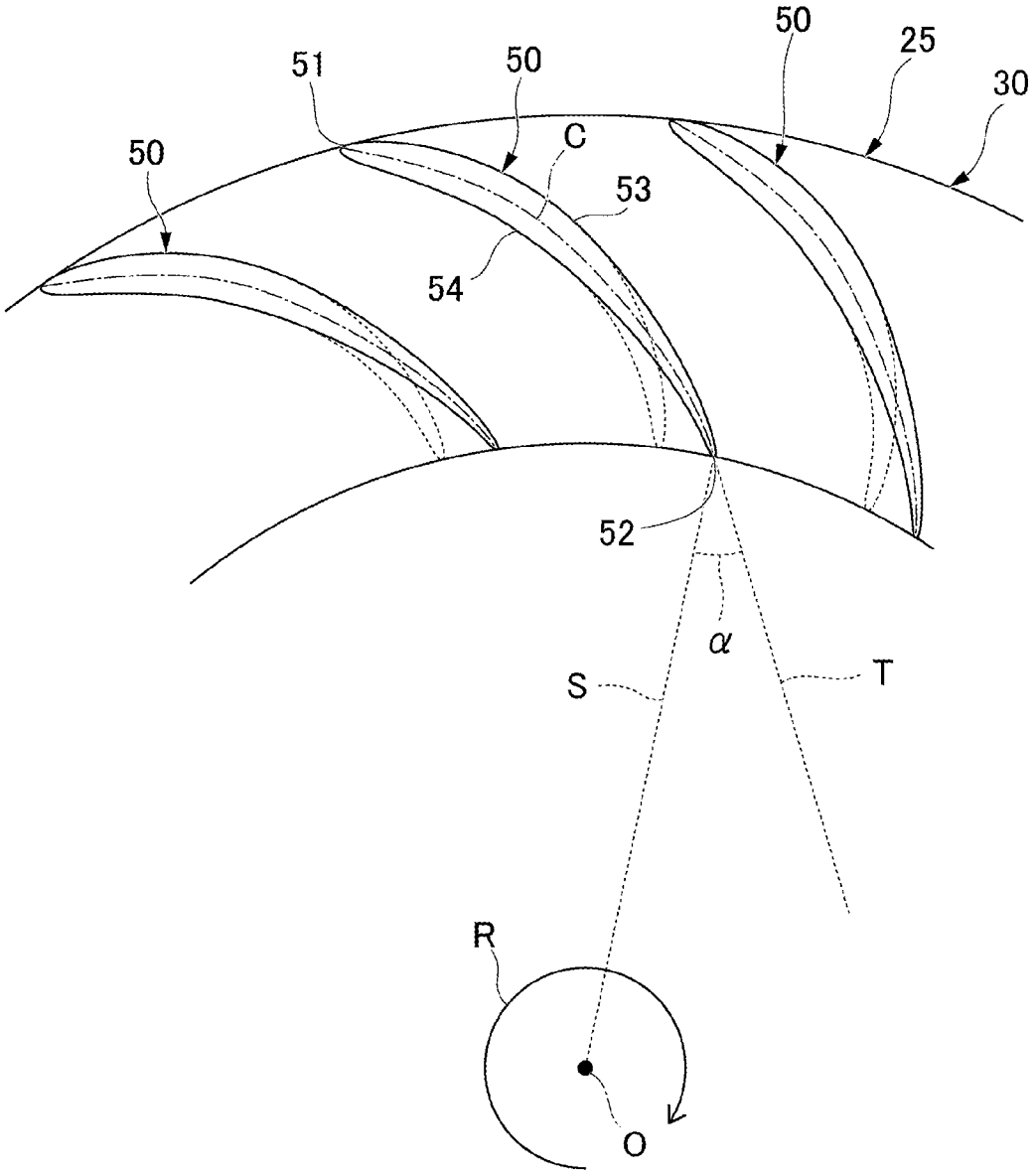
FIG. 3 is a view when a return vane of the centrifugal compressor according to the embodiment is viewed in a direction of an axis.

Next, the return vane 50 will be described. The plurality of return vanes 50 are disposed in the guide flow path 25 in the return flow path 30. More specifically, as shown in FIG. 3, the plurality of return vanes 50 are radially arrayed around the axis O in the guide flow path 25. In other words, the return vanes 50 are arrayed at an interval in the circumferential direction around the axis O. Both ends in the direction of the axis of the return vane 50 is in contact with the casing 3 forming the guide flow path 25.

The return vane 50 has a wing shape in which an outer end portion in the radial direction serves as a leading edge 51 and an inner end portion in the radial direction serves as a trailing edge 52 when viewed in the direction of the axis O. The return vane 50 extends forward in a rotation direction R of the rotary shaft 1 as the return vane 50 faces from the leading edge 51 toward the trailing edge 52. The return vane 50 is curved so as to project forward in the rotation direction R. A surface facing forward in the rotation direction R in the return vane 50 serves as a negative pressure surface 53, and a surface facing rearward in the rotation direction R serves as a pressure surface 54. When viewed in the direction of the axis O, a line having the same distance from the pressure surface 54 and the negative pressure surface 53 serves as a center line C.

According to the present embodiment, the trailing edge 52 of the return vane 50 faces forward in the rotation direction R. That is, an exit angle α of the return vane 50 is inclined forward in the rotation direction R. Here, the exit angle α means an acute angle formed by a tangential line T in the trailing edge 52 in the center line C of the return vane 50 when viewed in the direction of the axis O with respect to a reference line S passing through the trailing edge 52 and the axis O. The return vanes 50 in the same stage mutually have the same exit angle α.

Figure 4:
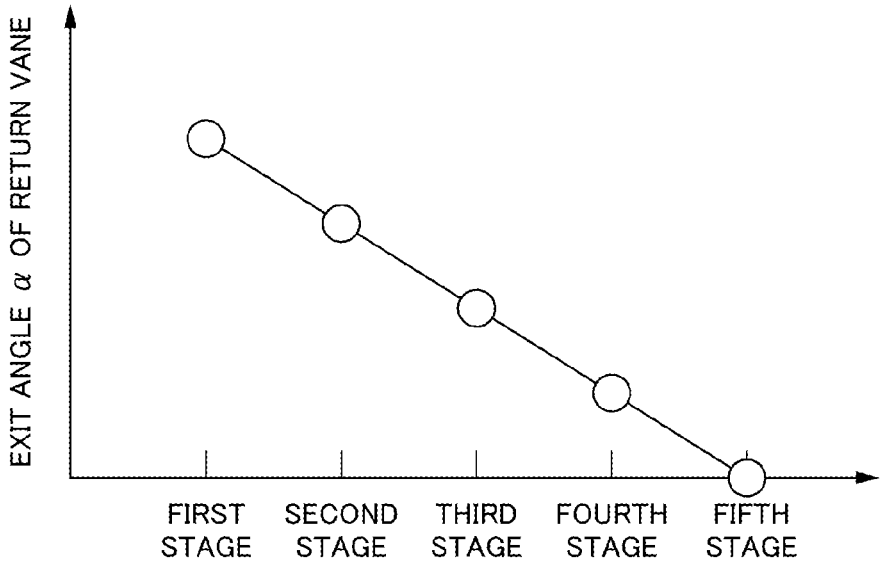
FIG. 4 is a graph showing an exit angle of the return vane in each stage.

According to the present embodiment, out of the return vanes 50 in the mutually adjacent stages in the direction of the axis O, the exit angle α of the return vane 50 (dashed line in FIG. 3) on the rear stage side is smaller than the exit angle α of the return vane 50 (solid line in FIG. 3) on the front stage side. That is, as shown in FIG. 4, the exit angle α of the return vane 50 monotonically and gradually decreases as the return vane 50 faces toward the rear stage side.

According to the present embodiment, even in the return vane 50 on the rear stage side, the trailing edge 52 of the return vane 50 does not face rearward in the rotation direction R. For example, as shown in FIG. 4, the exit angle α of the return vane 50 in the fifth stage is set to 0°. That is, the exit angle α of the return vane 50 is set to 0° or larger when a direction facing forward in the rotation direction R from the reference line S is set to a positive direction. The exit angle α of the return vane 50 in the fifth stage serving as a final stage having the return vane 50 may be larger than 0°.

Here, according to the present embodiment, a flow path cross-sectional area when viewed in the direction of the axis O in an inlet the respective impellers 4 is set to be larger for the impeller 4 in the front stage, and is set to decrease toward the impeller 4 in the rear stage. In this manner, the impeller 4 on the front stage side is the impeller 4 having a high flow rate, and the impeller 4 on the rear stage side is the impeller 4 having a low flow rate. Here, the flow rate means a volume flow rate.

Subsequently, an operation of the centrifugal compressor 100 according to the present embodiment will be described.

The working fluid G fetched into the flow path 2 from the suction port by rotating the rotary shaft 1 and the impeller 4 flows into the compression flow path 22 in the impeller 4 after passing through the suction flow path 21 in the first stage. The impeller 4 is rotated around the axis O by rotating the rotary shaft 1. Accordingly, a centrifugal force facing outward in the radial direction from the axis O is added to the working fluid G in the compression flow path 22. In addition, as described above, the cross-sectional area of the compression flow path 22 gradually decreases inward from the outside in the radial direction. Accordingly, the working fluid G is gradually compressed. In this manner, the high pressure working fluid G is fed from the compression flow path 22 to the subsequent diffuser flow path 23.

The high pressure working fluid G flows out of the compression flow path 22. Thereafter, the working fluid G sequentially passes through the diffuser flow path 23, the return bending portion 24, and the guide flow path 25. The impeller 4 and the flow path 2 in the second and subsequent stages are similarly compressed. Finally, the working fluid G is brought into a desired pressure state, and is supplied to an external device (not shown) from the exhaust port 8.

Here, during a process in which the working fluid G passes through the guide flow path 25, a portion of a turning component is removed by the return vane 50. That is, the working fluid G compressed by the impeller 4 passes through the diffuser flow path 23 and the return bending portion 24 in a state where the turning component is held in the rotation direction R of the impeller 4, and is introduced in guide flow path 25. In the guide flow path 25, the return vane 50 is curved in the radial direction from the circumferential direction as the return vane 50 faces from the leading edge 51 side to the trailing edge 52 side. Therefore, in the process in which the working fluid G is guided by the pressure surface 54 of the return vane 50, a portion of the turning component is removed.

According to the present embodiment, the return vane 50 does not remove all of the turning components. The trailing edge 52 of the return vane 50 is inclined outward in the radial direction, and has the exit angle α formed forward in the rotation direction R. Therefore, the working fluid G is introduced to the impeller 4 in the subsequent stage in a state where the turning component remains in the working fluid G. The rotation direction R of the turning component is the same as that of the rotary shaft 1 and the rotation direction R. Therefore, the working fluid G provided with the prewhirl is introduced to the impeller 4 in the subsequent stage.

Here, as the exit angle α of the return vane 50 increases, the working fluid G provided with a larger prewhirl is introduced to the impeller 4 on the rear stage side of the return vane 50. As the prewhirl of the working fluid G increases, a head of the impeller 4 decreases, and performance characteristics are changed to a small flow rate side. Conversely, if the prewhirl of the working fluid G decreases, the head of the impeller 4 relatively increases. As a result, the performance characteristics are changed to a high flow rate side.

According to the present embodiment, the flow path cross-sectional area in the inlet of the impeller 4 decreases toward the rear stage side. That is, the impeller 4 on the rear stage side has a lower flow rate than the impeller 4 on the front stage side. In contrast, as the return vane 50 is closer to the rear stage side, the exit angle α decreases. Therefore, the prewhirl generated by the return vane 50 decreases toward the rear stage side. Therefore, the working fluid G having the small volume flow rate in accordance with a design flow rate of the impeller 4 can be supplied to the impeller 4 on the rear stage side.

In a case where the exit angle α of the return vane 50 increases toward the rear stage side, the working fluid G having a large volume flow rate is supplied to the impeller 4 having a low flow rate on the rear stage side. Consequently, the choke margin excessively decreases. According to the present embodiment, the working fluid G having a low flow rate is supplied to the impeller 4 on the rear stage side by decreasing the prewhirl on the rear stage side. Therefore, the choke margin can be largely secured in the impeller 4.

In addition, in the multistage centrifugal compressor, the surge margin of the impeller 4 on the front stage side having the high flow rate is generally smaller than the surge margin of the impeller 4 on the rear stage side having the low flow rate. Therefore, according to the multistage centrifugal compressor, the entire surge margin is determined by the impeller 4 on the front stage side.

According to the present embodiment, as the return vane 50 is closer to the front stage side, the prewhirl of the working fluid G introduced to the impeller 4 increases. Therefore, as the impeller 4 is closer to the front stage side, the fluid having the large volume flow rate passes through the impeller 4.

In a case where the exit angle α of the return vane 50 increases toward the rear stage side, the fluid having the small volume flow rate is supplied to the impeller 4 having the small surge margin on the front stage side. Therefore, there is a negative effect in that the surge margin may decrease. According to the present embodiment, the working fluid G having the suitably large volume flow rate is supplied to the impeller 4 on the front stage side. Therefore, the surge margin can be largely secured.

Hitherto, the embodiment according to the present invention has been described. However, without being limited thereto, the present invention can be appropriately modified within the scope not departing from the technical idea of the invention.

In the embodiment, an example has been described in which the flow path cross-sectional area in the inlet of the impeller 4 decreases toward the rear stage side, and in which the exit angle α of the return vane 50 decreases toward the rear stage side. However, the present invention is not limited thereto. The above-described flow path cross-sectional areas may be the same as each other in some of the impellers 4 adjacent to each other. The exit angles α may be the same as each other between the return vanes 50 in the adjacent stages. That is, the flow path cross-sectional area in the inlet on the rear stage side may be larger between randomly selected impellers 4 adjacent to each other. Corresponding to the impellers 4, the exit angle α of the return vane 50 on the rear stage side may be smaller in the stages adjacent to each other.

In addition, as the flow path cross-sectional area in the inlet of the impeller 4 gradually decreases toward the rear stage side, the exit angle α of the return vane 50 may gradually decrease.

INDUSTRIAL APPLICABILITY

According to the centrifugal compressor of the present invention, an operation range can be broadened.

REFERENCE SIGNS LIST

1: rotary shaft
2: flow path
3: casing
4: impeller
5: journal bearing
6: thrust bearing
7: intake port
8: exhaust port
21: suction flow path
22: compression flow path
23: diffuser flow path
24: return bending portion
25: guide flow path
30: return flow path
41: disk
42: blade
43: cover
50: return vane
51: leading edge
52: trailing edge
53: negative pressure surface
54: pressure surface
100: centrifugal compressor
C: center line
T: tangential line
S: reference line
O: axis
R: rotation direction
G: working fluid
α: exit angle

What is claimed is:

1. A centrifugal compressor comprising:

a rotary shaft rotated around an axis;

impellers disposed so as to form a plurality of stages in a direction of the axis with respect to the rotary shaft and is configured to be pumped a fluid flowing from an inlet on one side in the direction of the axis to outward in a radial direction;

a casing that surrounds the rotary shaft and the impellers, and that has a return flow path through which the fluid discharged from an impeller on a front stage side between the impellers adjacent to each other is guided inward in the radial direction so as to be introduced to an impeller on a rear stage side; and a plurality of return vanes disposed at an interval in a circumferential direction inside the return flow path, wherein an exit angle of the return vane is inclined forward in a rotation direction of the impeller, according to the radial direction, and wherein the exit angle of the return vane gradually decreases toward the return vane on the rear stage side.

2. The centrifugal compressor according to claim 1, wherein a flow path cross-sectional area of the inlet of the impellers decrease toward the impeller on the rear stage side.

* * * * *